US011383515B2

(12) United States Patent
Sakuma et al.

(10) Patent No.: US 11,383,515 B2
(45) Date of Patent: Jul. 12, 2022

(54) ELEMENT SUBSTRATE, LIQUID DISCHARGE HEAD, AND PRINTING APPARATUS

(71) Applicant: CANON KABUSHIKI KAISHA, Tokyo (JP)

(72) Inventors: Sadayoshi Sakuma, Yokohama (JP); Yohei Osuki, Nagareyama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/848,983

(22) Filed: Apr. 15, 2020

(65) Prior Publication Data

US 2020/0338888 A1 Oct. 29, 2020

(30) Foreign Application Priority Data

Apr. 23, 2019 (JP) ..... JP2019-082197

(51) Int. Cl.
*B41J 2/14* (2006.01)
*B41J 2/045* (2006.01)

(52) U.S. Cl.
CPC ..... *B41J 2/14129* (2013.01); *B41J 2/0458* (2013.01); *B41J 2/1408* (2013.01); *B41J 2/14072* (2013.01); *B41J 2/14088* (2013.01); *B41J 2/14153* (2013.01); *B41J 2202/11* (2013.01); *B41J 2202/13* (2013.01); *B41J 2202/18* (2013.01)

(58) Field of Classification Search
CPC ..... B41J 2/14129; B41J 2/14072; B41J 2202/13; B41J 2202/18; B41J 2202/11
See application file for complete search history.

(56) References Cited

U.S. PATENT DOCUMENTS

| | | | |
|---|---|---|---|
| 5,081,474 | A | 1/1992 | Shibata et al. |
| 7,722,148 | B2 | 5/2010 | Takabayashi et al. |
| 7,950,765 | B2 | 5/2011 | Takabayashi et al. |
| 8,172,355 | B2 | 5/2012 | Takabayashi et al. |

(Continued)

FOREIGN PATENT DOCUMENTS

| | | | |
|---|---|---|---|
| CN | 105818537 | A | 8/2016 |
| CN | 109203695 | A | 1/2019 |

(Continued)

OTHER PUBLICATIONS

Co-Pending U.S. Appl. No. 16/848,975, filed Apr. 15, 2020.

*Primary Examiner* — Geoffrey S Mruk
(74) *Attorney, Agent, or Firm* — Venable LLP

(57) ABSTRACT

An element substrate comprises: a first insulation layer between a heater layer where plural heaters are formed, and a first wiring layer; and a second wiring layer formed within the first insulation layer, where an individual wiring connected to each heater is formed; a first metal plug that fills an interior of a first through-hole penetrating from the heater layer to the second wiring layer; and a second metal plug, provided in a place different from a place where the first through-hole is formed, that fills an interior of a second through-hole penetrating from the second wiring layer to the first wiring layer. Each heater is connected to the second wiring layer via the first metal plug, and the second wiring layer is connected to the first wiring layer via the second metal plug.

15 Claims, 11 Drawing Sheets

(56) References Cited

U.S. PATENT DOCUMENTS

| | | | | |
|---|---|---|---|---|
| 10,035,346 | B2 | 7/2018 | Kasai et al. | |
| 10,493,774 | B2 | 12/2019 | Kanno et al. | |
| 10,543,685 | B2 | 1/2020 | Naruse et al. | |
| 2007/0229566 | A1 | 10/2007 | Takabayashi et al. | |
| 2010/0194810 | A1 | 8/2010 | Takabayashi et al. | |
| 2011/0164085 | A1 | 7/2011 | Takabayashi et al. | |
| 2016/0152027 | A1 | 6/2016 | Uyama et al. | |
| 2016/0297194 | A1 | 10/2016 | Sakurai et al. | |
| 2018/0370233 | A1 | 12/2018 | Kasai et al. | |
| 2019/0001678 | A1 | 1/2019 | Naruse et al. | |
| 2019/0001680 | A1* | 1/2019 | Miura | H05K 1/111 |
| 2019/0105921 | A1* | 4/2019 | Kanno | B41J 2/04563 |

FOREIGN PATENT DOCUMENTS

| | | | |
|---|---|---|---|
| CN | 109649012 | A | 4/2019 |
| JP | 2007-290361 | A | 11/2007 |
| JP | 2016-137705 | A | 8/2016 |

* cited by examiner

ELEMENT SUBSTRATE, LIQUID DISCHARGE HEAD, AND PRINTING APPARATUS

BACKGROUND OF THE INVENTION

Field of the Invention

The present invention relates to an element substrate, a liquid discharge head, and a printing apparatus, and particularly to, for example, a printing apparatus using, as a printhead, a liquid discharge head incorporating an element substrate that suppresses dissolution by ink to perform printing in accordance with an inkjet method.

Description of the Related Art

A liquid discharging apparatus represented by an inkjet printing apparatus needs to implement higher image quality and higher speed. In general, an inkjet printing method using a thermal method is a method of locally heating a liquid such as ink to generate bubbles in a nozzle, and discharging the ink from the nozzle by the bubbles and making the ink fly and land on a printed target. In a printhead according to this method, electrothermal transducers configured to heat ink are integrated on a semiconductor substrate integrally with a logic circuit configured to drive the electrothermal transducers. In the printhead, to meet the above-described requirement of higher image quality and higher speed, the electrothermal transducers are densely arranged, thereby implementing high-speed driving.

Japanese Patent Laid-Open No. 2016-137705 describes a method of providing an element substrate aiming at reducing the film thickness of an electrothermal transducer (heater) protective film while ensuring printing performance of high image quality and the performance of the protective film in a printhead according to the thermal method. The element substrate includes an electrothermal transducer, an electric wiring layer provided in an insulation film and configured to supply a current to the electrothermal transducer, and a connecting member such as a plug that connects the electric wiring layer and the electrothermal transducer. At this time, the electrothermal transducer is formed such that the current flows in the first direction (X), the electrothermal transducer includes a connection region to which at least one connecting member is connected, and the connection region extends along the second direction (Y) crossing the first direction (X).

In the element substrate having such a structure, the dimensional accuracy of formation of an electrode to be connected to the electrothermal transducer can be increased, and the film thickness of the protective film can be reduced by suppressing a step difference under the protective film. However, when the film thickness of the protective film is reduced, if an unexpected pinhole is formed in the protective film, a liquid such as ink may enter from that portion into the element region of the protective film. This increases the possibility that an electrothermal transducer, an electric connecting member, an electric wiring, or the like comes into contact with the liquid. As described above, device reliability may lower along with the reduction of the film thickness of the protective film.

In the above-described conventional example, if a pinhole or the like is formed in the protective film that coats the element substrate, the ink may enter to below the protective film so that an electrothermal transducer, a plug that is an electric connecting member, a conductive film such as an electric wiring, and an insulation film may dissolve into the ink, and corrosion may progress. In addition, if wiring corrosion derived from a certain electrothermal transducer greatly progresses, and the corrosion reaches a wiring portion connected to an electrothermal transducer on the periphery, driving may be unstable not only in the electrothermal transducer as the starting point of the corrosion but also in the electrothermal transducer on the periphery, and normal driving may be impossible.

Depending on the arrangement of a driving circuit, a high potential may be applied to an electrode pair or wiring connected to drive the electrothermal transducer. In the electrode or electric wiring with the high potential, a so-called electric corrosion action, that is, progress of an anode reaction on an ink contact interface increases the progress speed of corrosion in a metallic film that is a wiring material. Hence, particularly for the wiring of the high potential, a countermeasure to suppress or prevent the progress of corrosion needs to be taken.

SUMMARY OF THE INVENTION

Accordingly, the present invention is conceived as a response to the above-described disadvantages of the conventional art.

For example, an element substrate, a liquid discharge head, and a printing apparatus according to this invention are capable of suppressing spread of electric corrosion of a wiring connected to a heater.

According to one aspect of the present invention, there is provided a multilayer structured element substrate including a heater layer in which a plurality of heaters configured to discharge a liquid are formed, and a first wiring layer in which a common wiring configured to supply a voltage from an outside to the plurality of heaters is formed, comprising: a second wiring layer formed between the heater layer and the first wiring layer in a lamination direction and made of a high anticorrosion material to the discharged liquid as compared to the first wiring layer; a first metal plug that is in contact with a surface of the second wiring layer on a side of the heater layer, and fills an interior of a first through-hole elongated to the side of the heater layer; and a second metal plug that is in contact with a surface of the second wiring layer on a side of the first wiring layer in a place different from a place where the first through-hole is formed when the element substrate is viewed in a planar view, and fills an interior of a second through-hole elongated to the side of the first wiring layer, wherein each of the plurality of heaters is connected to the second wiring layer via the first metal plug, and the second wiring layer is connected to the common wiring via the second metal plug.

According to another aspect of the present invention, there is provided a liquid discharge head using the above described multilayer structured element substrate, comprising a plurality of orifices configured to discharge a liquid.

According to still another aspect of the present invention, there is provided a printing apparatus for performing printing on a print medium using the above described liquid discharge head configured to discharge a liquid as a printhead configured to discharge ink as the liquid, wherein the plurality of heaters are in contact with the ink, and the ink is discharged from the orifices by driving the plurality of heaters.

The invention is particularly advantageous since it is possible to suppress spread of corrosion of a wiring connected to a heater. This can suppress the influence of progress of wiring corrosion on heaters on the periphery and maintain the operation reliability of the element substrate.

Further features of the present invention will become apparent from the following description of exemplary embodiments (with reference to the attached drawings).

DESCRIPTION OF THE EMBODIMENTS

Figure 1:
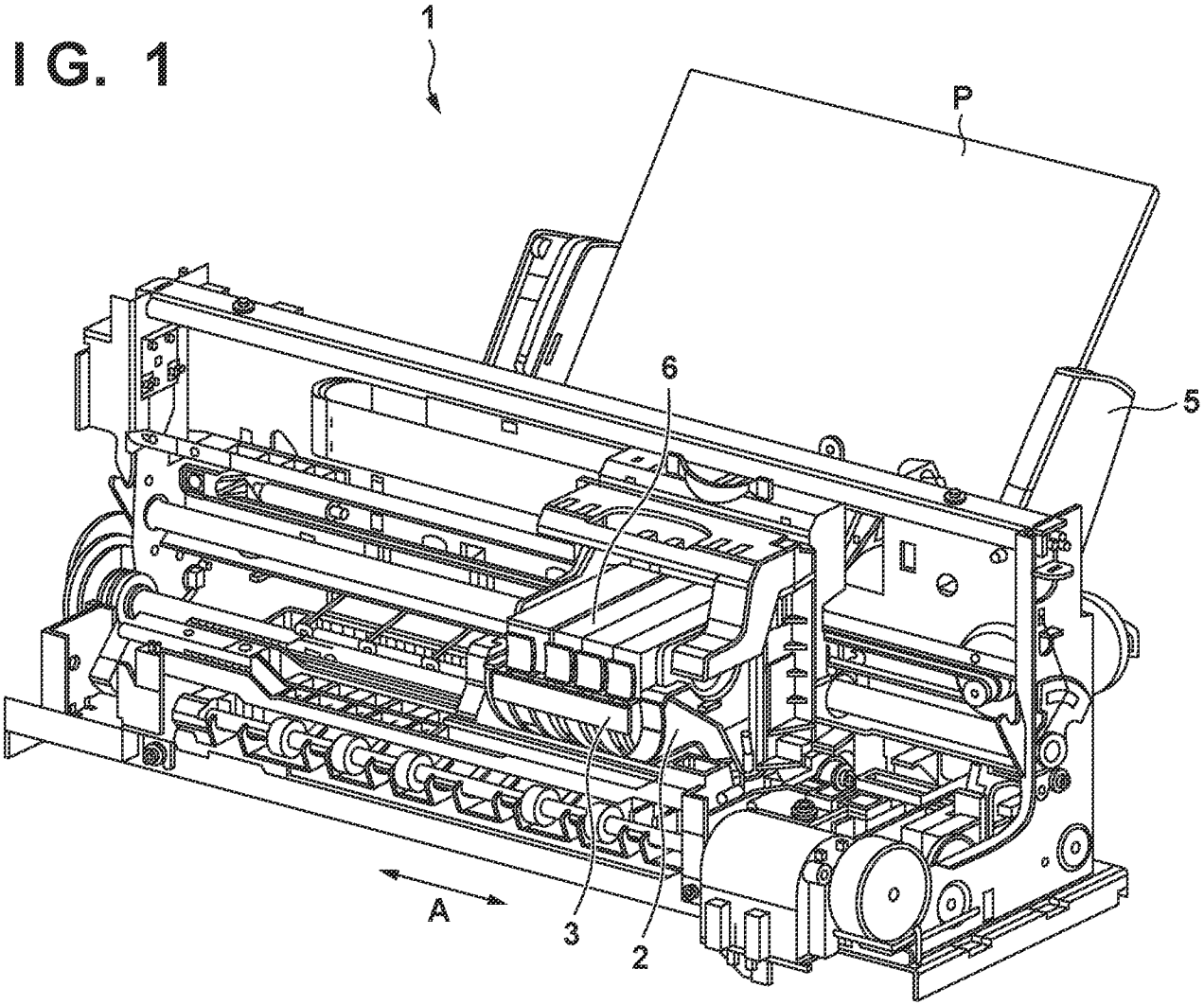
FIG. 1 is a perspective view showing the schematic arrangement of a printing apparatus including a printhead according to an exemplary embodiment of the present invention.

Exemplary embodiments of the present invention will now be described in detail in accordance with the accompanying drawings. It should be noted that the following embodiments are not intended to limit the scope of the appended claims. A plurality of features are described in the embodiments. Not all the plurality of features are necessarily essential to the present invention, and the plurality of features may arbitrarily be combined. In addition, the same reference numerals denote the same or similar parts throughout the accompanying drawings, and a repetitive description will be omitted.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be broadly interpreted to be similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "nozzle" (to be also referred to as "print element" hereinafter) generically means an ink orifice or a liquid channel communicating with it, and an element for generating energy used to discharge ink, unless otherwise specified.

An element substrate for a printhead (head substrate) used below means not merely a base made of a silicon semiconductor, but an arrangement in which elements, wirings, and the like are arranged.

Further, "on the substrate" means not merely "on an element substrate", but even "the surface of the element substrate" and "inside the element substrate near the surface". In the present invention, "built-in" means not merely arranging respective elements as separate members on the base surface, but integrally forming and manufacturing respective elements on an element substrate by a semiconductor circuit manufacturing process or the like.

<Description of Outline of Printing Apparatus (FIGS. 1 and 2)>

FIG. 1 is an external perspective view showing the outline of the arrangement of a printing apparatus that performs printing using an inkjet printhead (to be referred to as a printhead hereinafter) according to an exemplary embodiment of the present invention.

As shown in FIG. 1, in an inkjet printing apparatus (to be referred to as a printing apparatus hereinafter) 1, an inkjet printhead (to be referred to as a printhead hereinafter) 3 configured to discharge ink in accordance with an inkjet method to perform printing is mounted on a carriage 2. The carriage 2 is reciprocally moved in the direction of an arrow A to perform printing. A print medium P such as print paper is fed via a paper feed mechanism 5, conveyed to a printing position, and ink is discharged from the printhead 3 to the print medium P at the printing position, thereby performing printing.

In addition to the printhead 3, an ink tank 6 storing ink to be supplied to the printhead 3 is attached to the carriage 2 of the printing apparatus 1. The ink tank 6 is detachable from the carriage 2.

A printing apparatus 1 shown in FIG. 1 can perform color printing, and for the purpose, four ink cartridges storing magenta (M), cyan (C), yellow (Y), and black (K) inks, respectively, are mounted on the carriage 2. The four ink cartridges are detachable independently.

The printhead 3 according to this embodiment employs an inkjet method of discharging ink using thermal energy. Hence, the printhead 3 includes an electrothermal transducer (heater). The electrothermal transducer is provided in correspondence with each orifice. A pulse voltage is applied to a corresponding electrothermal transducer in accordance with a print signal, thereby discharging ink from a corresponding orifice. Note that the printing apparatus is not limited to the above-described serial type printing apparatus, and the embodiment can also be applied to a so-called full line type printing apparatus in which a printhead (line head)

with orifices arrayed in the widthwise direction of a print medium is arranged in the conveyance direction of the print medium.

Figure 2:
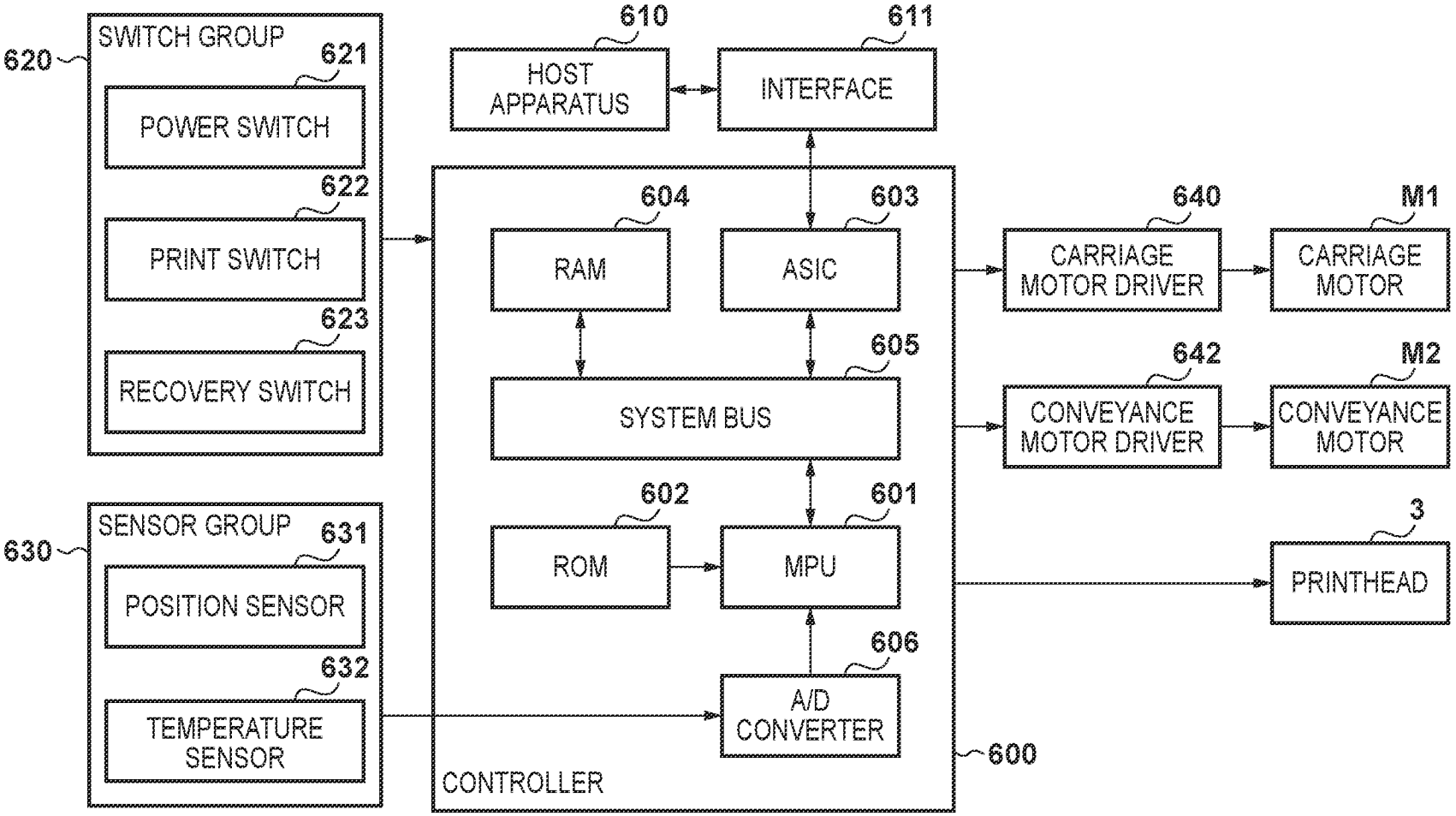
FIG. 2 is a block diagram showing the control configuration of the printing apparatus shown in FIG. 1.

FIG. 2 is a block diagram showing the control configuration of the printing apparatus shown in FIG. 1.

As shown in FIG. 2, a controller 600 is formed by an MPU 601, a ROM 602, an application specific integrated circuit (ASIC) 603, a RAM 604, a system bus 605, an A/D converter 606, and the like. Here, the ROM 602 stores programs corresponding to control sequences to be described later, necessary tables, and other fixed data. The ASIC 603 generates control signals for control of a carriage motor M1, control of a conveyance motor M2, and control of the printhead 3. The RAM 604 is used as an image data expansion area, a working area for program execution, and the like. The system bus 605 connects the MPU 601, the ASIC 603, and the RAM 604 to each other to exchange data. The A/D converter 606 receives an analog signal from a sensor group to be described below, performs A/D conversion, and supplies a digital signal to the MPU 601.

Additionally, referring to FIG. 2, reference numeral 610 denotes a host apparatus, which serves as an image data supply source. Image data, commands, statuses, and the like are transmitted/received by packet communication between the host apparatus 610 and the printing apparatus 1 via an interface (I/F) 611. Note that as the interface 611, a USB interface may be provided independently of a network interface to receive bit data or raster data serially transferred from the host.

Reference numeral 620 denotes a switch group which is formed by a power switch 621, a print switch 622, a recovery switch 623, and the like.

Reference numeral 630 denotes a sensor group configured to detect an apparatus state and formed by a position sensor 631, a temperature sensor 632, and the like.

Reference numeral 640 denotes a carriage motor driver that drives the carriage motor M1 configured to reciprocally scan the carriage 2 in the direction of the arrow A; and 642, a conveyance motor driver that drives the conveyance motor M2 configured to convey the print medium P.

The ASIC 603 transfers data used to drive a heating element (a heater for ink discharge) to the printhead while directly accessing the storage area of the RAM 604 at the time of print scan by the printhead 3. In addition, the printing apparatus includes a display unit formed by an LCD or an LED as a user interface.

Figure 3B:
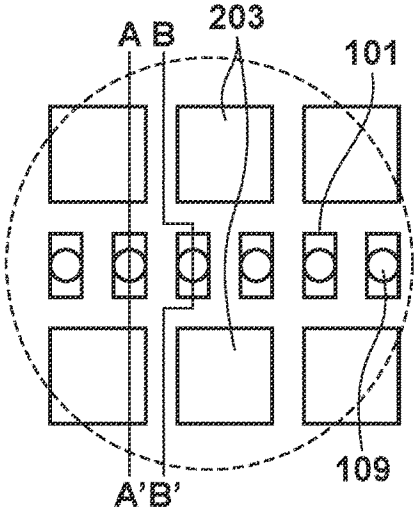
FIGS. 3A and 3B are views showing the layout arrangement of an element substrate (head substrate) integrated on a printhead.
Figure 3A:
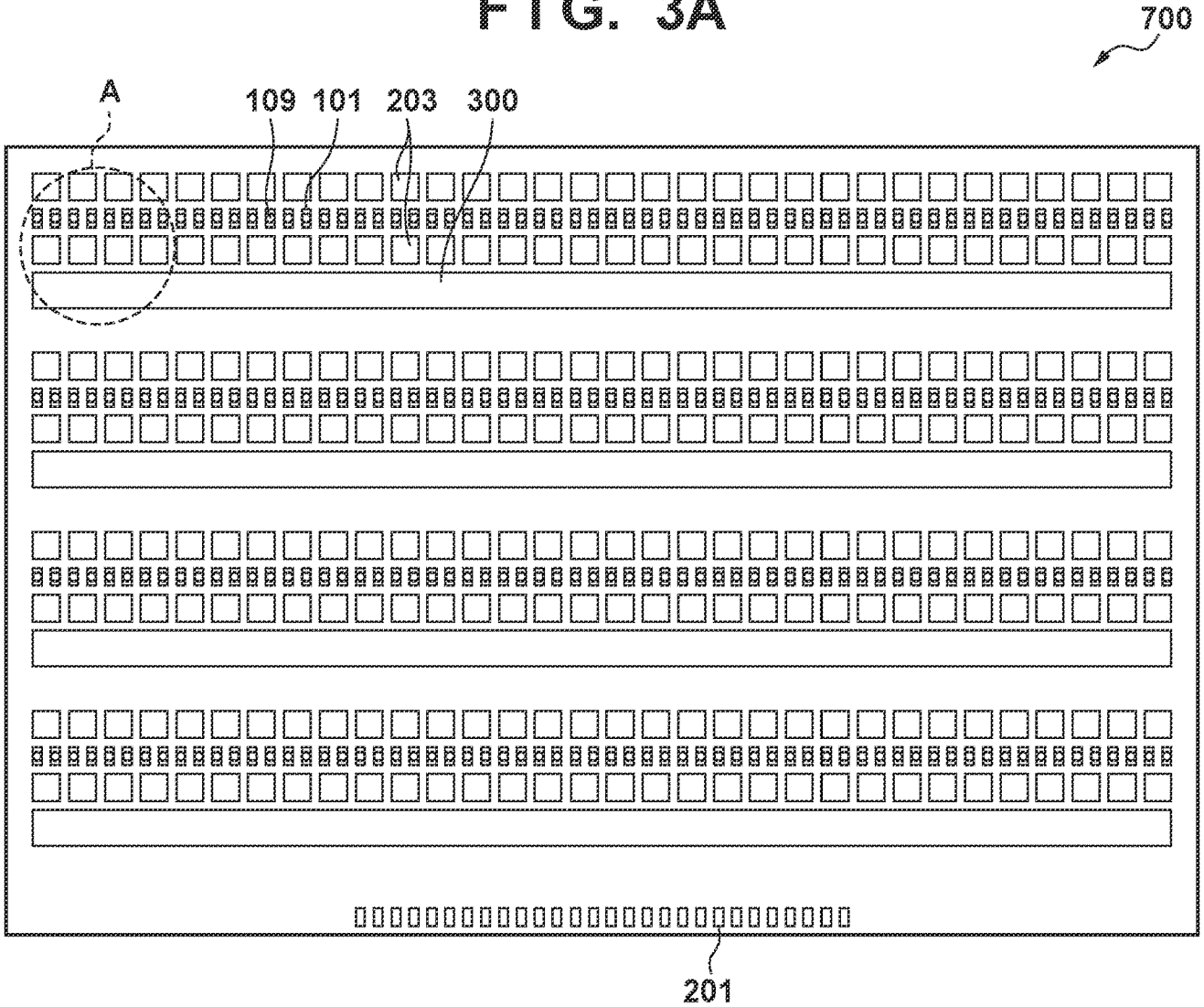

FIGS. 3A and 3B are plan views showing the layout arrangement of an element substrate 700 integrated on the printhead 3.

The plane of the element substrate 700 shown in FIG. 3A has a rectangular shape. A plurality of pads 201 are provided along the long side of the rectangular plane of the element substrate 700, and data and a driving voltage are supplied from the outside (the main body portion of the printing apparatus) via the pads. A plurality of heaters 101, a plurality of orifices 109, a plurality of ink supply ports 203, and a plurality of switching elements 300 are arrayed in the long side direction of the element substrate 700.

In the example shown in FIG. 3A, four heater arrays, four orifice arrays, eight ink supply port arrays, and four switching element arrays are provided. The ink supply port arrays are formed on both sides of each of the four heater arrays. Magenta (M), cyan (C), yellow (Y), and black (K) inks are supplied to the four ink supply port arrays, respectively.

FIG. 3B is an enlarged view of a portion A shown in FIG. 3A.

As shown in FIG. 3B, the orifice 109 that discharges ink droplets is provided in correspondence with each heater 101, and the switching elements 300 that drive the heaters are provided on both sides of the orifices. As is apparent from FIGS. 3A and 3B, the array pitch of the heaters is ½ of the array pitch of the switching elements. Hence, for example, in FIG. 3B, a heater is driven by the switching element of the array on the upper side, and an adjacent heater of the heater is driven by the switching element of the array on the lower side.

Figure 4:
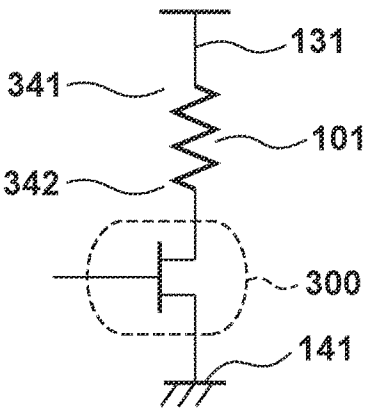
FIG. 4 is a view showing an equivalent circuit of a driving circuit configured to drive one heater.

FIG. 4 is a view showing an equivalent circuit of a driving circuit configured to drive one heater.

As shown in FIG. 4, a connecting portion 341 on one side of the heater (electrothermal transducer) 101 is electrically connected to a VH common wiring 131 used to supply a voltage. In addition, the other connecting portion 342 of the heater 101 is electrically connected to a GND common wiring 141 via the switching element 300 (driver) configured to switch ON/OFF of driving of the heater 101. In this embodiment, the switching element 300 is a MOSFET. A driving voltage from the outside is applied to the gate of the MOSFET to switch ON/OFF and drive the heater 101.

Embodiments of the element substrate integrated on the printhead of the printing apparatus with the above-described arrangement will be described next.

First Embodiment

Here, an element substrate having a conventional arrangement will be described first as a comparative example, and then, the features of an element substrate according to this embodiment will be described.

Comparative Example and Problem

Figure 5A:
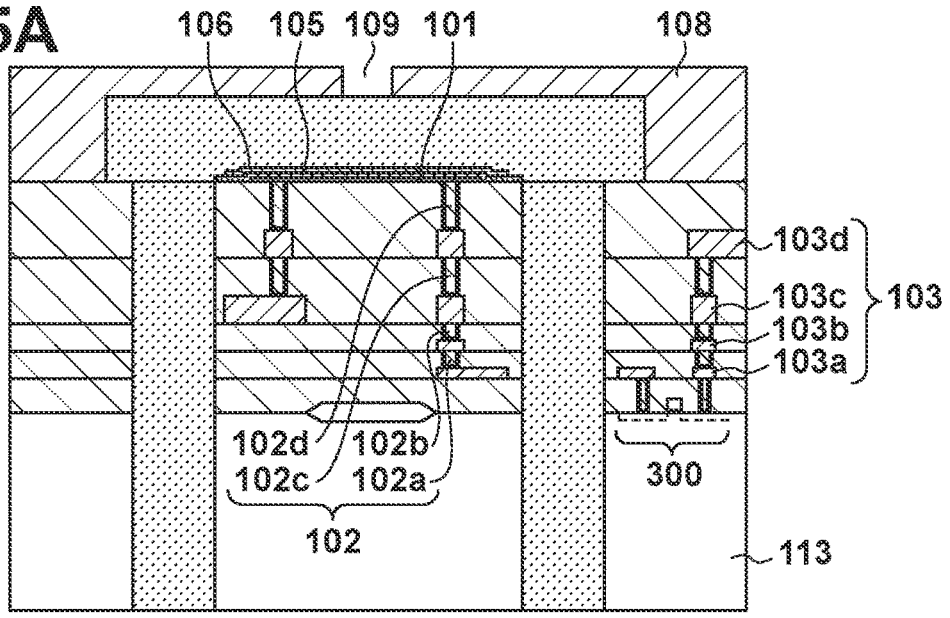
FIGS. 5A and 5B are sectional views showing the multilayer structure of an element substrate as a comparative example.
Figure 5B:
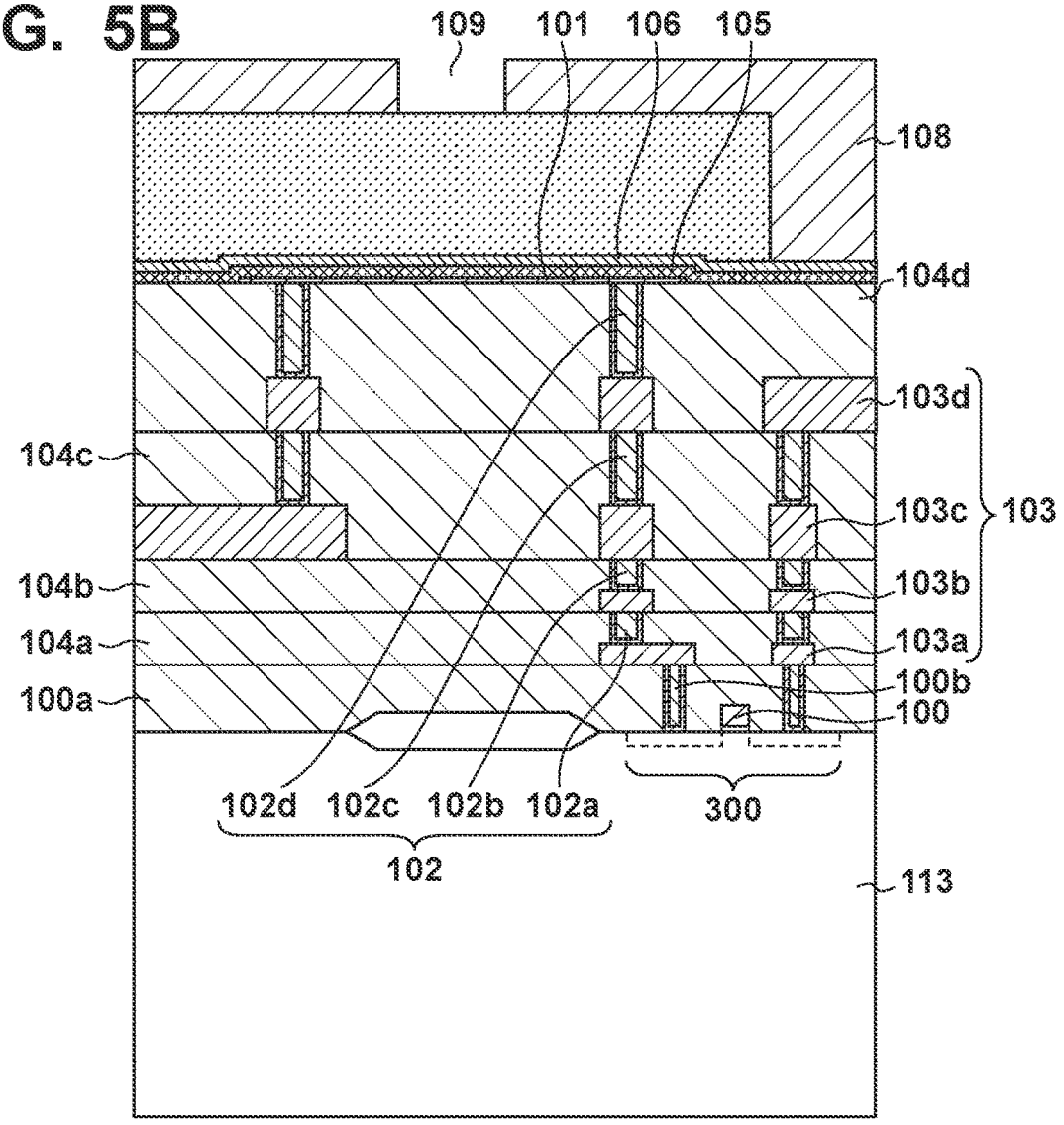

FIGS. 5A and 5B are sectional views showing the multilayer structure of an element substrate as a comparative example. FIG. 5A is a sectional view taken along a line A-A' shown in FIG. 3B, and FIG. 5B is a sectional view taken along a line B-B' shown in FIG. 3B.

As shown in FIGS. 5A and 5B, a Poly-Si layer 100, wiring layers 103*a*, 103*b*, 103*c*, and 103*d*, a heater 101, and an anti-cavitation layer 106 are formed on an Si substrate 113. The Poly-Si layer, the wiring layers, and the heater are insulated by insulation layers 100*a*, 104*a*, 104*b*, 104*c*, and 104*d* sequentially from the lower layer to the upper layer. In addition, through-holes that penetrate the insulation layers to electrically connect the wirings formed in the wiring layers are formed from the lower layer to the upper layer. Note that the place where the plurality of heaters are formed is called a heater layer. The electric wirings are thus configured as four layers whose distances from the heater (electrothermal transducer) 101 are different from each other. Note that on the heater 101, a protective film 105 configured to prevent the heater from directly coming into contact with ink is formed. The protective film 105 is an insulation layer configured to insulate the heater 101 and the anti-cavitation layer 106 from each other. An orifice 109 is formed by a hole in a top plate 108 that covers an element substrate 700.

The electric wiring layers will be defined as the first wiring layer 103*a*, the second wiring layer 103*b*, the third wiring layer 103*c*, and the fourth wiring layer 103*d* from the lower layer side. The first wiring layer 103*a* and the second wiring layer 103*b* on the side close to the Si substrate 113 of the lower layer are assigned to a signal wiring layer and a logic power supply wiring layer used to drive the heater 101. In addition, the third wiring layer 103*c* and the fourth wiring layer 103*d* on the upper layer side are assigned to wiring layers used to supply a current to the heater 101. The wiring layers 103*a* to 103*d* are made of, for example, aluminum or an alloy (for example, AlSi or AlCu) containing aluminum.

A GND wiring is formed in the fourth wiring layer 103*d*, and a VH power supply wiring is formed in the third wiring layer 103*c*. Both the VH power supply wiring and the GND wiring are common wirings to a plurality of heaters, and will therefore also be referred to as a VH power supply common wiring and a GND common wiring hereinafter. The VH power is supplied from the outside (the main body portion of the printing apparatus) of the printhead.

Also, the wiring layers of the upper layers and the lower layers are connected by metal plugs (connecting members) 100*b* and 102*a* to 102*d* formed in through-holes formed to penetrate the insulation layers 100*a* and 104*a* to 104*d*, respectively. A barrier metal formed by a titanium nitride (TiN) film or the like is formed on the lower surface and the side surface of each through-hole, and the lower surface side and the side surface side of the metal plug are surrounded by the barrier metal. Note that the four wiring layers 103*a* to 103*d* will generically be referred to as wiring layers 103, and the four metal plugs 102*a* to 102*d* will generically be referred to as connecting members 102.

With the above-described multilayer wiring structure, it is possible to make the wire resistance low while suppressing an increase in the size of the element substrate.

Figure 6:
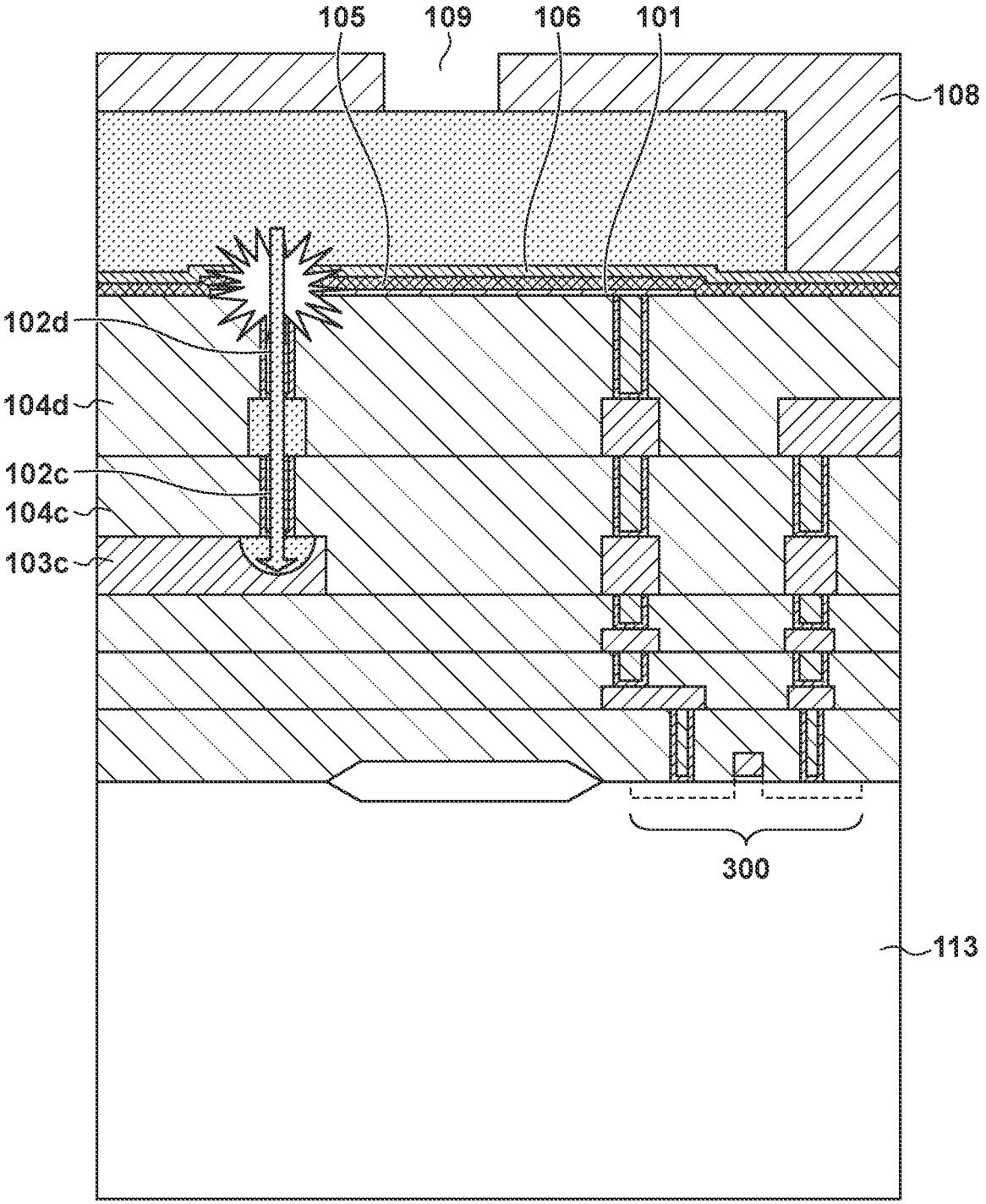
FIG. 6 is a sectional view showing a state in which corrosion of an electric wiring of the element substrate has progressed.

FIG. 6 is a sectional view taken along a line B-B' shown in FIG. 3B in a case in which corrosion of an electric wiring of the element substrate has progressed. Note that the same reference numerals as already described with reference to FIGS. 5A and 5B denote similar constituent elements in FIG. 6, and a description thereof will be omitted.

The example of FIG. 6 schematically shows a state in which corrosion of the metal plugs 102*d* and 102*c* and the wiring of the wiring layer 103*c* has progressed up to the VH power supply common wiring. The VH power supply common wiring formed in the third wiring layer 103*c* is configured to feed power to an adjacent heater as well. For this reason, if the wiring corrosion progresses more widely, power feeding to peripheral heaters cannot be performed, and an ink discharge failure may occur.

As an example of a cause of corrosion of an electric wiring or the connecting member 102, a pinhole or the like is formed in the protective film 105, and ink (liquid) enters from it to cause corrosion, as described above.

Figure 7A:
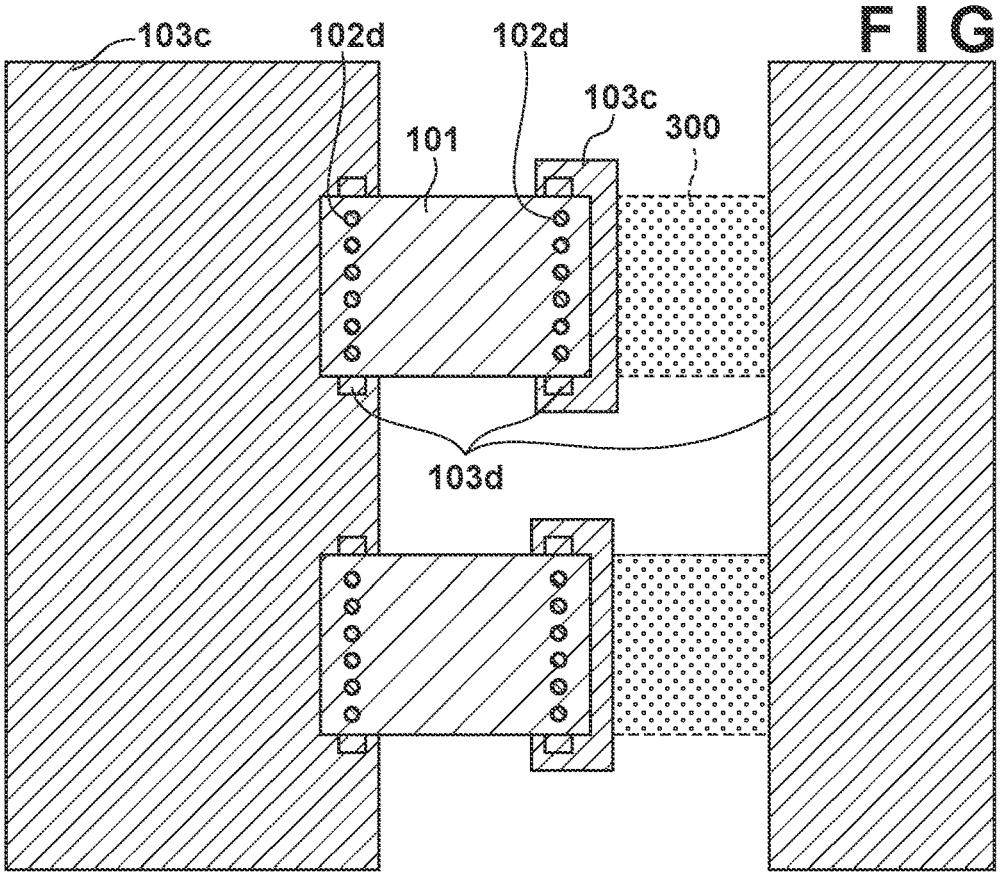
FIGS. 7A and 7B are plan views showing the schematic arrangement of the vicinity of heaters 101 on the element substrate.
Figure 7B:
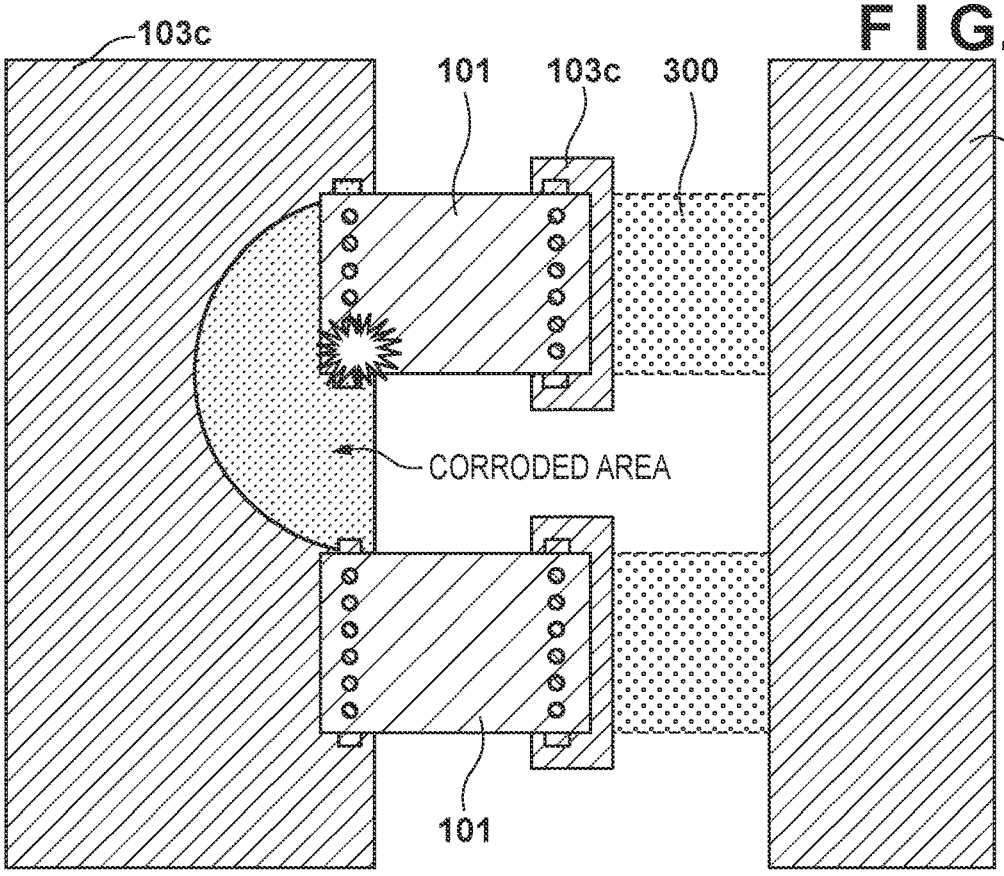

FIGS. 7A and 7B are plan views showing the schematic arrangement of the vicinity of the heaters 101 on the element substrate.

As shown in FIG. 7A, one terminal of each heater 101 is connected to the VH power supply common wiring formed in the wiring layer 103*c* via the metal plug 102*d* that fills the through-hole. The other terminal of each heater 101 is connected to the switching element 300 formed in the lowermost layer via the metal plug 102*d* that fills the through-hole. The switching element 300 is connected to the GND common wiring formed in the wiring layer 103*d*.

If corrosion progresses from the heater 101, the corrosion progresses up to the wiring layer 103*c* in which the VH power supply common wiring is formed, as shown in FIG. 7B. If the corrosion reaches the wiring region used to feed power to the adjacent heater 101, power feeding cannot be performed, and an ink discharge failure may occur. Note that FIG. 7B shows an example in which corrosion occurs on the VH power supply wiring side. Even in a case in which corrosion occurs on the GND wiring side, wiring corrosion similarly progresses, and the same problem as described above may arise.

General thoughts concerning the corrosion resistance of a metallic film will be described here. In general, the features of the corrosion resistance of a metal are roughly classified into three types.

§ General Thoughts Concerning Corrosion Resistance of Metal

The first type is a metal that does not corrode in itself, or a metal that has stability and hardly corrodes. Most metallic corrosions are electrochemical reactions that occur due to a potential difference on the surface. When an anode reaction occurs on a metal surface, and the metal dissolves as metal ions, metallic corrosion progresses. The easiness of dissolution and the easiness of ionization are represented by an ionization tendency. The smaller the ionization tendency of a metal is, the more hardly corrosion occurs. That is, it can be said that a noble metal has a high corrosion resistance. Examples are noble metals such as gold, platinum, iridium, palladium, and silver.

The second type is a metal that hardly corrodes when a passivation film is formed on the surface. As for a metal of this type, a very thin film called a passivation film is formed on the surface, and this prevents corrosion from progressing. As a characteristic, when broken, the passivation film immediately reacts with oxygen or the like to do self-repairing. The strength of the passivation film and what readily breaks the passivation film are different depending on the metal. Titanium, tantalum, zirconium, niobium, and the like correspond to metals of this type.

The third type is a metal for which a corroded product is formed on the surface, and which functions as a protective film. The corroded products of some metals corrode the metals to tatters, and the corroded products of some metals prevent progress of corrosion to some extent and function like a protective film when formed on a surface. Hence, depending on the type of the metal, the corroded product may directly act as a protective film. Examples are copper, zinc, and lead.

As another index, the presence/absence of metallic corrosion progress in an electrolysis solution will generally be described using a potential-ph diagram.

The potential-ph diagram is a state diagram showing the regions of a potential and a ph in which metals, metal ions, and metal compounds can stably exist at a predetermined temperature. More specifically, in the potential-ph diagram, the existing region of a chemical species (particularly a metal) in water is shown as the stable existence range of the chemical species on two-dimensional coordinates by plotting an electrode potential corresponding to the oxidizing power of a solution along the ordinate and ph along the abscissa. It is possible to read, from the potential-ph diagram, whether a specific oxide or complex ions are generated at a specific potential and ph of a given metal or whether a reaction does not occur. Titanium nitride that is a nitride of titanium is a material widely used as a barrier metal or an antireflection film in general, and is also a very hard ceramic material, and has a corrosion resistance. For this reason, this material is used as a coating to a cutting tool such as a cutter. Titanium is ionized and dissolved in an environment of a liquid with an acidic ph and a negative potential. In a neutral or alkaline ph environment of a general print ink, since titanium takes an oxidation region independently of its potential, it can be read that the titanium does not dissolve.

Since titanium has such a characteristic, titanium nitride that is a nitride of titanium is also considered to have a corrosion resistance.

The general corrosion resistance of a metal has been described above. The detailed material is merely an example. The progress speed of corrosion is different depending on the temperature environment, the potential of the target metal, and an electrolyte to which the metal is exposed. The corrosion resistances of various kinds of metals change depending on the influence of the peripheral environment.

§ Anticorrosion Conductive Film

As a conductive material usable as an anticorrosion wiring layer, for example, a metal nitride such as titanium nitride (TiN) or tantalum nitride (TaN) is a material generally used as a barrier metal in a semiconductor manufacturing process. Since the conductive film can readily be incorporated in the manufacturing process of the element substrate and has a high corrosion resistance, it can particularly readily be applied. In addition, a nitride film made of zirconium nitride, niobium nitride, vanadium nitride, or tungsten nitride, or an alloy such as TaSiN, TiSiN, or WSiN can also be used. In addition to these metal nitride films, a metal simple substance such as titanium, tantalum, zirconium, or niobium or titanium, tantalum, or the like whose surface oxide film has a corrosion resistance can also be applied.

As described above, the barrier metal layer formed to surround the metal plug is made of a metal nitride film such as titanium nitride (TiN). Titanium nitride is a material frequently used as a diffusion prevention film or a contact film for a semiconductor element substrate, and has a high corrosion resistance. For this reason, even if ink enters into the element substrate, and an aluminum alloy that is a wiring material or tungsten (W) that is a metal plug dissolves or corrodes in the ink, the titanium nitride film remains without corroding.

The titanium nitride film is thus formed as a barrier metal layer to surround the metal plug. In general, when forming titanium nitride by sputtering film formation, the titanium nitride film is not always evenly formed on the bottom portion of the through-hole formed to penetrate the insulation layer. Hence, there may be a portion where the coatability of the metal plug is insufficient. In particular, the larger the aspect ratio (through-hole height/through-hole diameter) of the through-hole is, the more hardly the film forming material reaches the bottom portion of the through-hole, and the more hardly coatability is obtained.

For this reason, although the film is illustrated in the drawing as if it were evenly formed, in fact, there may be a portion where the coatability of the barrier metal layer formed on the bottom portion of the metal plug is not sufficiently obtained. Hence, if the corrosion of tungsten of the metal plug progresses to the bottom portion of the through-hole, the ink enters from the portion where the coatability of the barrier metal layer is insufficient, and the aluminum wiring layer in the lower layer of the element substrate corrodes.

For this reason, there is demand for a structure that suppresses progress of corrosion by providing a layer having a corrosion resistance higher than that of the barrier metal layer of the metal plug.

<Description of Outline of First Embodiment>

For the above-described problem, to suppress progress of corrosion of a metal plug or a wiring, in this embodiment, a titanium nitride film that has a high corrosion resistance and is generally used as a barrier metal is used as a wiring layer. The multilayer structured element substrate is characterized in that metal plugs that connect wiring layers of an upper layer and a lower layer are arranged at a distance L in a direction orthogonal to the arrangement direction of wiring layers in the multilayer structure not to overlap each other, and a wiring region formed in a flat portion inside an insulation film intervenes between them. Hence, it is preferable that the wiring layer made of a material having a corrosion resistance is arranged on, for example, a flat portion such as the CMP-polished upper surface of an insulation film or a metal plug and serves as a pathway of a current.

Figure 8:
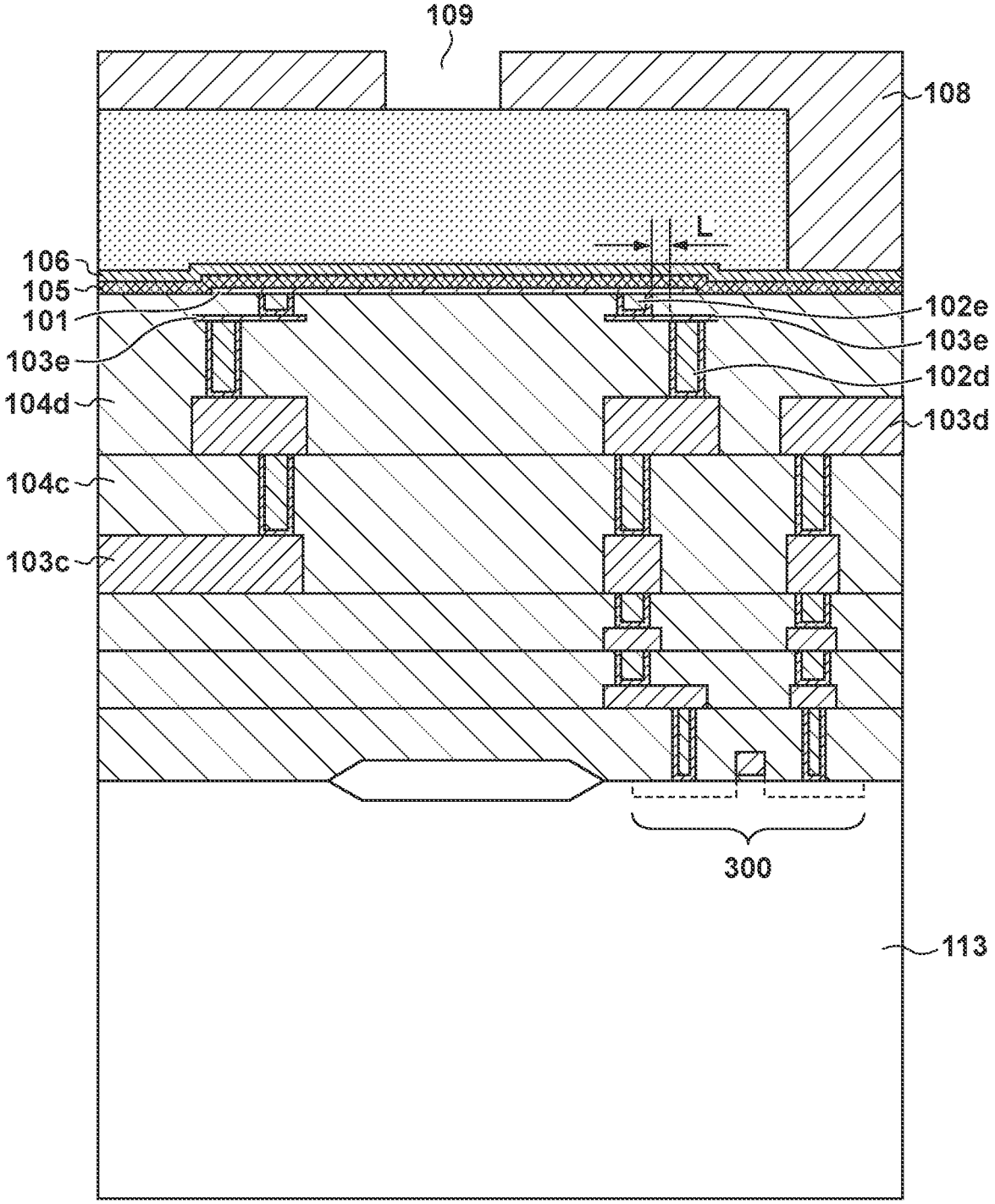
FIG. 8 is a sectional view showing the multilayer structure of an element substrate according to the first embodiment.

FIG. 8 is a sectional view showing the multilayer structure of an element substrate according to the first embodiment. Note that the same reference numerals as already described with reference to FIGS. 5A and 5B and 6 denote similar constituent elements in FIG. 8, and a description thereof will be omitted. A characteristic arrangement of the first embodiment and its effect will be described here. Like FIG. 5B, this sectional view is a sectional view taken along a line B-B' shown in FIG. 3B.

As shown in FIG. 8, an anticorrosion wiring layer 103*e* is formed in the insulation layer 104*d*. The anticorrosion wiring layer 103*e* is formed between the heater 101 and the wiring layer 103*d* concerning the lamination direction of the layers in the element substrate. The anticorrosion wiring layer 103*e* is connected to a metal plug 102*e* and the metal plug 102*d*. The metal plug 102*e* is in contact with the surface of the anticorrosion wiring layer 103*e* on the side of the heater 101 and is elongated to the side of the heater 101. The metal plug 102*d* is in contact with the surface of the anticorrosion wiring layer 103*e* on the side of the wiring layer 103*d* and is elongated to the side of the wiring layer 103*d*. The metal plug 102*e* connected to the heater 101 in the upper layer with respect to the anticorrosion wiring layer 103*e* and the metal plug 102*d* connected to the wiring layer 103*d* in the lower layer with respect to the anticorrosion wiring layer 103*e* are arranged while being shifted by the distance L on a plane. That is, the metal plug 102*e* and the metal plug 102*d* are formed in difference places when the element substrate is viewed in a planar view. With this arrangement, the anticorrosion wiring layer 103*e* of the flat portion serves as an electric pathway between the heater 101 of the upper layer and the wiring layer 103*d* of the lower layer. Here, the anticorrosion wiring layer 103*e* is made of a material whose corrosion resistance to discharged ink is higher than that of, for example, the wiring layer 103*d*, and is preferably made of a material having a corrosion resistance as will be described later.

Note that the flat portion in the insulation layer 104*d* includes a region where the upper surface of the insulation film formed on the wiring layer 103*d* is planarized by CMP or the like, and a region where no through-hole is formed in the insulation film. Alternatively, the flat portion includes a region where no pattern step difference exists at the time of formation of the insulation film because a wiring pattern or the like is not formed in the lower layer, and unevenness to an extent in which the step difference on the insulation film surface can be regarded sufficiently small with respect to the film thickness of the film material of a wiring or the like formed on the insulation film.

In the conventional arrangement described as a comparative example, both the VH power supply common wiring and the GND common wiring are connected from the fourth wiring layer 103*d* to the heater 101 via the metal plug 102*d*.

On the other hand, in this embodiment, as shown in FIG. 8, both the VH power supply common wiring and the GND common wiring are connected from the fourth wiring layer 103*d* to the heater 101 via the anticorrosion wiring layer 103*e* as an individual wiring layer. At this time, the anticorrosion wiring layer 103*e* has the wiring length L between the two metal plugs 102*d* and 102*e*. This is a value determined from the planar shift amount of the metal plugs used to connect to the upper layer and the lower layer with respect to the anticorrosion wiring layer 103*e* and their plug sizes.

From the viewpoint of preventing wiring corrosion progress that is the objective of the present invention, the wiring length L of the anticorrosion wiring is preferably 1 μm or more. In addition, since the specific resistance of the wiring is relatively high, the wiring length L is preferably 20 μm or less from the viewpoint of an increase in the wire resistance. At this time, different wiring lengths L may be used on the VH power supply common wiring side and the GND common wiring side. For example, L on the VH power supply common wiring side with a larger fear of wiring corrosion progress may be set larger. In addition, the wire resistance can be suppressed by setting a relatively large wiring film thickness.

According to the arrangement of the above-described embodiment, the two terminals of the heater are connected to the wiring layer of the lower layer via the anticorrosion wiring layer. Even if the wiring connected to the two terminals of the heater breaks, and the metal plug made of tungsten is dissolved by ink, progress of dissolution can be suppressed by another metal plug covered with a barrier metal layer with a high coatability.

Note that the anticorrosion wiring layer may form a common wiring layer that is commonly electrically connected to a plurality of heaters. However, to suppress spread of corrosion in the element substrate, the anticorrosion wiring layer preferably forms individual wirings that are individually connected to a plurality of heaters, as in this embodiment.

Second Embodiment

In the first embodiment, the anticorrosion wiring is applied to both the VH power supply common wiring and the GND common wiring. An example in which an anticorrosion wiring material is applied to a VH power supply common wiring to which a high potential is applied will be described here.

Figure 9:
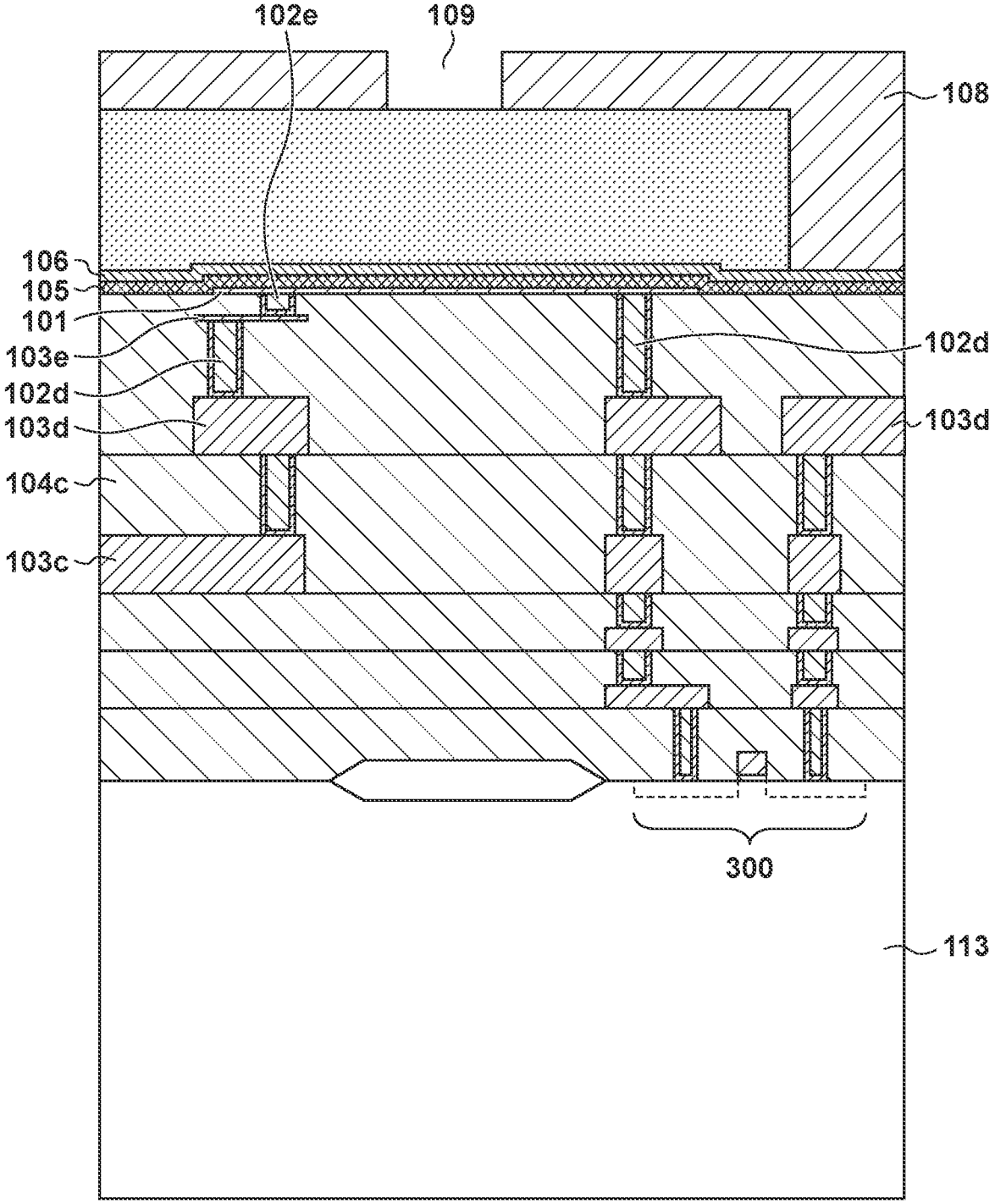
FIG. 9 is a sectional view showing the multilayer structure of an element substrate according to the second embodiment.

FIG. 9 is a sectional view showing the multilayer structure of an element substrate according to the second embodiment. Note that the same reference numerals as already described with reference to FIGS. 5A, 5B, 6, and 8 denote the same constituent elements in FIG. 9, and a description thereof will be omitted. A characteristic arrangement of the second embodiment will be described here.

As the reason why the arrangement shown in FIG. 9 is employed, a conductive material with a corrosion resistance represented by a metal nitride film has a high specific resistance as compared to an aluminum alloy, copper, and the like which are used as a wiring material in general, and it is difficult to use the material for all wiring routings from the viewpoint of the wire resistance. Hence, the anticorrosion material is used only in a minimum region that needs a corrosion resistance near a heater 101, thereby simultaneously implementing suppression of a wire resistance and prevention of wiring corrosion or electric corrosion at the time of an unexpected wire break in the heater.

In an electrode pair configured to feed power to the heater 101, one electrode has a high potential because a VH voltage is applied, and the other electrode has a low potential because it is connected to GND. In these electrodes and wirings connected to them, corrosion by electric corrosion readily progresses on the high potential side. Hence, to minimize the wire resistance and obtain an effect, only the side connected to the VH power supply common wiring, which is the portion close to the heater 101 on the high potential side, is connected to a wiring layer 103*d* via an anticorrosion wiring layer 103*e*. For a remaining portion, for example, a portion connected to the heater 101 on the low potential side, a conventional low-resistance wiring material such as an aluminum alloy or copper is used.

According to the above-described embodiment, only the VH power supply common wiring side to which a high voltage is applied is connected via the anticorrosion wiring layer, unlike the first embodiment. In this arrangement as well, even if the wiring between the heater and the VH power supply common wiring breaks, and the metal plug made of tungsten is dissolved by ink, progress of dissolution can be suppressed by another metal plug covered with a barrier metal layer with a high coatability.

Third Embodiment

In the first and second embodiments, an arrangement in which connection to the wiring layer 103*d* immediately under the heater 101 is done via the anticorrosion wiring layer has been described. An arrangement in which connection of a wiring layer on a side close to an Si substrate 113 of a lower layer is done via an anticorrosion wiring layer will be described here.

Figure 10:
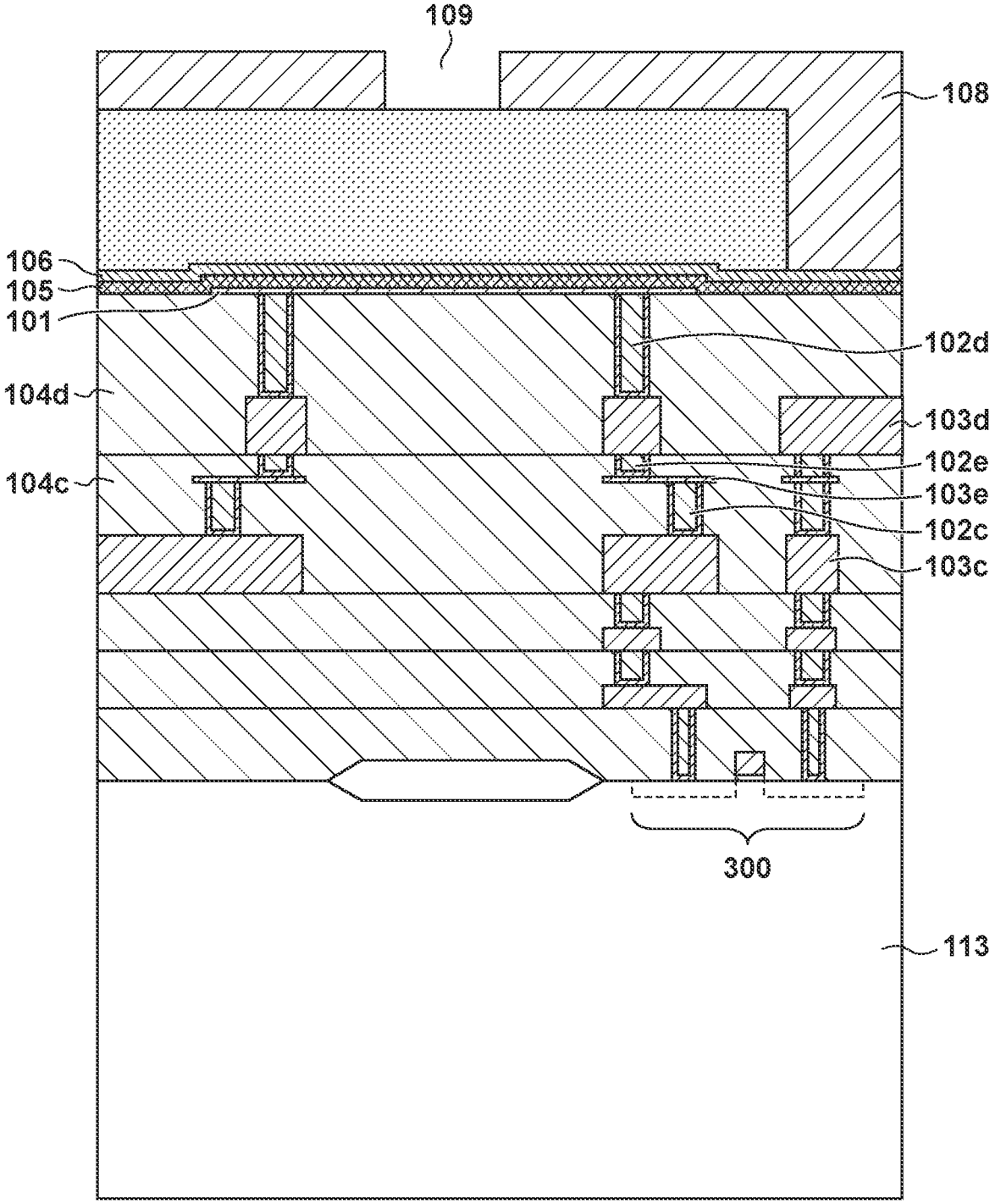
FIG. 10 is a sectional view showing the multilayer structure of an element substrate according to the third embodiment.

FIG. 10 is a sectional view showing the multilayer structure of an element substrate according to the third embodiment. Note that the same reference numerals as already described with reference to FIGS. 5A, 5B, 6, 8, and 9 denote the same constituent elements in FIG. 10, and a description thereof will be omitted. A characteristic arrangement of the third embodiment will be described here.

As shown in FIG. 10, in an element substrate according to this embodiment, an individual wiring is formed in an anticorrosion wiring layer 103*e* formed in an insulation layer 104*c* that is a lower layer close to the side of the Si substrate 113, as compared to the first and second embodiments. The anticorrosion wiring layer 103*e* is connected to a wiring layer 103*d* of the upper layer via a metal plug 102*e*, and connected to a wiring layer 103*c* of the lower layer via a metal plug 102*c*.

The starting point of corrosion is a heater 101 or a pinhole in a protective film 105. If ink enters into the element substrate, and the periphery of a region where an overcurrent has flown instantaneously due to a short circuit between wirings is largely broken, the anticorrosion wiring portion may also be broken in the first embodiment. In this embodiment, however, the anticorrosion material is used as a wiring in the portion of a lower layer. It is therefore possible to avoid damage to the anticorrosion wiring by a break that cannot be prevented in the first embodiment.

Fourth Embodiment

Figure 11:
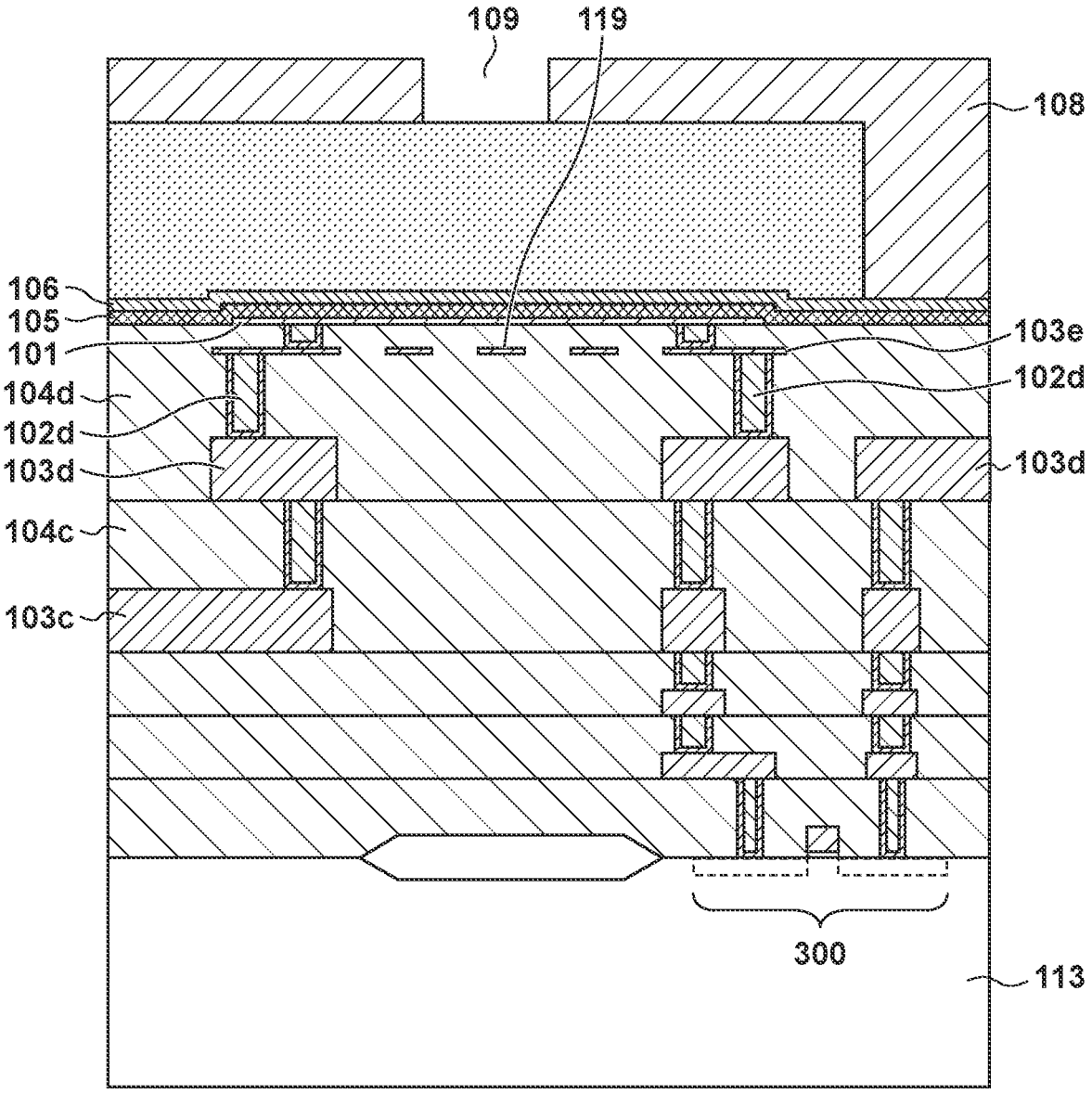
FIG. 11 is a sectional view showing the multilayer structure of an element substrate according to the fourth embodiment.

FIG. 11 is a sectional view showing the multilayer structure of an element substrate according to the fourth embodiment. Note that the same reference numerals as already described with reference to FIGS. 5A, 5B, 6, 8, 9, and 10 denote similar constituent elements in FIG. 11, and a description thereof will be omitted. A characteristic arrangement of the fourth embodiment will be described here.

Figure 12:
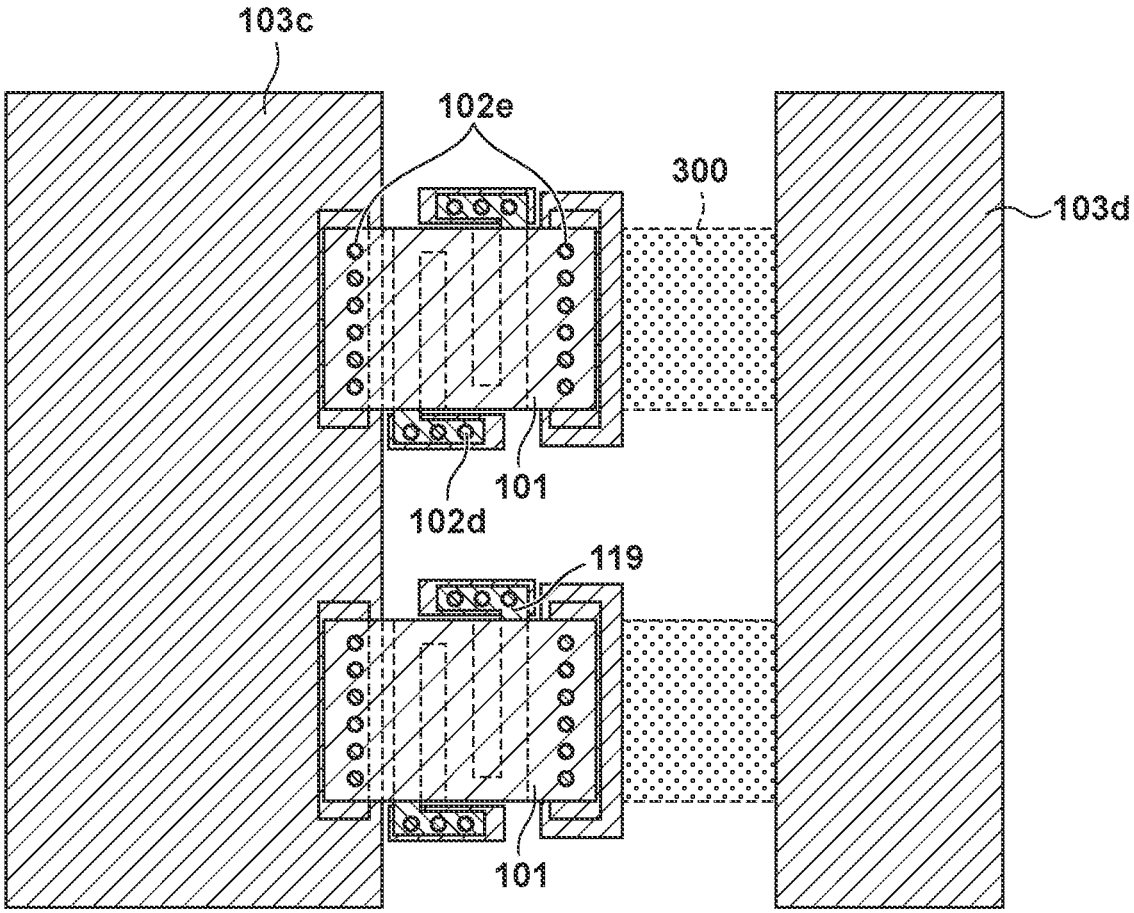
FIG. 12 is a plan view showing the state of the wirings of two heaters integrated on the element substrate shown in FIG. 11.

FIG. 12 is a plan view showing the schematic arrangement in the vicinity of a heater 101 on the element substrate.

As is apparent from comparison between FIGS. 11 and 8, in this embodiment, in addition to the arrangement of the first embodiment, at the same level as an anticorrosion wiring layer 103*e* in an insulation layer 104*d* immediately under the heater 101, a temperature detection element 119 that is a thin-film resistor is formed using the same material.

The temperature detection element 119 detects the temperature of the heater 101, thereby detecting whether the heater normally operates, and ink is discharged. The outline of the temperature detection element is disclosed in Japanese Patent Laid-Open No. 2007-290361, and a detailed description thereof will be omitted here. Japanese Patent Laid-Open No. 2007-290361 discloses an element substrate in which a plurality of heaters configured to generate thermal energy to discharge ink are formed on a silicon substrate, and thin-film temperature detection elements are formed immediately under the heaters with an interlayer insulation film intervening between them.

According to Japanese Patent Laid-Open No. 2007-290361, a temperature detection circuit detects temperature information from each temperature detection element, and determines, based on the difference between the temperature change of the heaters at the time of ink discharge failure and the temperature change of the heaters at the time of normal ink discharge, whether the ink discharge is normal, or a discharge failure has occurred. Temperature detection is performed by monitoring a change in the value of the electrical resistance of each temperature detection element.

According to the above-described embodiment, the temperature detection elements and the anticorrosion wiring layer are simultaneously built in when manufacturing the element substrate using a semiconductor manufacturing process, thereby reducing manufacturing processes.

Note that in the above-described embodiments, the printhead that discharges ink and the printing apparatus have been described as an example. However, the present invention is not limited to this. The present invention can be applied to an apparatus such as a printer, a copying machine, a facsimile including a communication system, or a word processor including a printer unit, and an industrial printing apparatus complexly combined with various kinds of processing apparatuses. In addition, the present invention can also be used for the purpose of, for example, biochip manufacture, electronic circuit printing, color filter manufacture, or the like.

The printhead described in the above embodiments can also be considered as a liquid discharge head in general. The substance discharged from the head is not limited to ink, and can be considered as a liquid in general.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-082197, filed Apr. 23, 2019, which is hereby incorporated by reference herein in its entirety.

What is claimed is:

1. A multilayer structured element substrate including a heater layer in which a plurality of heaters configured to discharge a liquid are formed, and a first wiring layer in which a common wiring configured to supply a voltage from an outside to the plurality of heaters is formed, comprising:

a second wiring layer formed between the heater layer and the first wiring layer in a lamination direction and made of a high anticorrosion material to the discharged liquid as compared to the first wiring layer, the second wiring layer being thinner than the first wiring layer;

a first metal plug that is in contact with a surface of the second wiring layer on a side of the heater layer, and fills an interior of a first through-hole elongated to the side of the heater layer; and a second metal plug that is in contact with a surface of the second wiring layer on a side of the first wiring layer in a place different from a place where the first through-hole is formed when the element substrate is viewed in a planar view, and fills an interior of a second through-hole elongated to the side of the first wiring layer, wherein each of the plurality of heaters is connected to the second wiring layer via the first metal plug, and the second wiring layer is connected to the common wiring via the second metal plug.

2. The element substrate according to claim 1, wherein the second wiring layer forms an individual wiring configured to individually connect each of the plurality of heaters, and each of the plurality of heaters is connected to the common wiring via the individual wiring.

3. The element substrate according to claim 1, wherein two second wiring layers are formed for each of the plurality of heaters, the first through-hole and the second through-hole are formed in correspondence with each of the two second wiring layers, the interior of the first through-hole is filled with the first metal plug, and the interior of the second through-hole is filled with the second metal plug, one terminal of each of the plurality of heaters is connected to the first wiring layer via the first metal plug that fills the first through-hole and the second metal plug that fills the second through-hole, formed in one wiring layer of the two second wiring layers, and the other terminal of each of the plurality of heaters is connected to the first wiring layer via the first metal plug that fills the first through-hole and the second metal plug that fills the second through-hole, formed in the other wiring layer of the two second wiring layers.

4. The element substrate according to claim 1, wherein one terminal of each of the plurality of heaters is connected to the second wiring layer via the first metal plug, and the second wiring layer is connected to the first wiring layer via the second metal plug.

5. The element substrate according to claim 1, further comprising a third wiring layer made of the same material as the first wiring layer and electrically connected to the plurality of heaters, wherein the first wiring layer is formed closer to the heater layer than the third wiring layer in the lamination direction.

6. The element substrate according to claim 1, further comprising:

a third wiring layer formed between the heater layer and the first wiring layer;

an insulation layer provided between the third wiring layer and the heater layer; and a third metal plug that fills a third through-hole penetrating the insulation layer, wherein each of the plurality of heaters is further connected to the third wiring layer via the third metal plug and connected from the third wiring layer to the first metal plug.

7. The element substrate according to claim 1, further comprising a temperature detection element corresponding to each of the plurality of heaters and formed at the same level as the second wiring layer on a section in the lamination direction.

8. The element substrate according to claim 1, wherein the second wiring layer has a corrosion resistance.

9. The element substrate according to claim 8, wherein the second wiring layer having the corrosion resistance is substantially made of a metal nitride selected from a group consisting of titanium nitride, tantalum nitride, zirconium nitride, vanadium nitride, niobium nitride, tungsten nitride, and an alloy thereof.

10. The element substrate according to claim 1, wherein when the element substrate is viewed in a planar view, in the second wiring layer, a distance between the first through-hole and the second through-hole is 1 μm to 20 μm.

11. The element substrate according to claim 1, wherein a lower surface side and a side surface side of the first metal plug in the first through-hole and a lower surface side and a side surface side of the second metal plug in the second through-hole are coated with a barrier metal layer.

12. The element substrate according to claim 11, wherein the first metal plug and the second metal plug are substantially made of tungsten, and the barrier metal layer is substantially made of one of titanium and a material containing titanium.

13. A liquid discharge head using a multilayer structured element substrate including a heater layer in which a plurality of heaters configured to discharge a liquid are formed, and a first wiring layer in which a common wiring configured to supply a voltage from an outside to the plurality of heaters is formed, comprising a plurality of orifices configured to discharge the liquid, wherein the element substrate comprises:

a second wiring layer formed between the heater layer and the first wiring layer in a lamination direction and made of a high anticorrosion material to the discharged liquid as compared to the first wiring layer, the second wiring layer being thinner than the first wiring layer;

a first metal plug that is in contact with a surface of the second wiring layer on a side of the heater layer, and fills an interior of a first through-hole elongated to the side of the heater layer; and a second metal plug that is in contact with a surface of the second wiring layer on a side of the first wiring layer in a place different from a place where the first through-hole is formed when the element substrate is viewed in a planar view, and fills an interior of a second through-hole elongated to the side of the first wiring layer, wherein each of the plurality of heaters is connected to the second wiring layer via the first metal plug, and the second wiring layer is connected to the common wiring via the second metal plug.

14. The liquid discharge head according to claim 13, wherein the liquid is ink, and the liquid discharge head is an inkjet printhead.

15. A printing apparatus for performing printing on a print medium using a liquid discharge head configured to discharge a liquid as a printhead configured to discharge ink as the liquid, wherein the liquid discharge head comprises:

a multilayer structured element substrate including a heater layer in which a plurality of heaters configured to discharge the liquid are formed, and a first wiring layer in which a common wiring configured to supply a voltage from an outside to the plurality of heaters is formed; and a plurality of orifices configured to discharge the liquid, wherein the element substrate comprises:

a second wiring layer formed between the heater layer and the first wiring layer in a lamination direction and made of a high anticorrosion material to the discharged liquid as compared to the first wiring layer, the second wiring layer being thinner than the first wiring layer;

a first metal plug that is in contact with a surface of the second wiring layer on a side of the heater layer, and fills an interior of a first through-hole elongated to the side of the heater layer; and a second metal plug that is in contact with a surface of the second wiring layer on a side of the first wiring layer in a place different from a place where the first through-hole is formed when the element substrate is viewed in a planar view, and fills an interior of a second through-hole elongated to the side of the first wiring layer, wherein each of the plurality of heaters is connected to the second wiring layer via the first metal plug, and the second wiring layer is connected to the common wiring via the second metal plug, and the plurality of heaters are in contact with the ink, and the ink is discharged from the orifices by driving the plurality of heaters.

* * * * *